US010076902B2

(12) United States Patent
Kanno et al.

(10) Patent No.: US 10,076,902 B2
(45) Date of Patent: Sep. 18, 2018

(54) PRINT ELEMENT SUBSTRATE, LIQUID EJECTION HEAD, AND PRINTING DEVICE

(71) Applicant: CANON KABUSHIKI KAISHA, Tokyo (JP)

(72) Inventors: Hideo Kanno, Yokohama (JP); Ryo Kasai, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/602,690

(22) Filed: May 23, 2017

(65) Prior Publication Data

US 2017/0341370 A1 Nov. 30, 2017

(30) Foreign Application Priority Data

May 27, 2016 (JP) ..... 2016-106466
Apr. 26, 2017 (JP) ..... 2017-087600

(51) Int. Cl.
*B41J 2/045* (2006.01)
*B41J 2/14* (2006.01)

(52) U.S. Cl.
CPC ..... *B41J 2/0451* (2013.01); *B41J 2/0458* (2013.01); *B41J 2/04541* (2013.01); *B41J 2/04563* (2013.01); *B41J 2/04586* (2013.01); *B41J 2/1433* (2013.01); *B41J 2202/20* (2013.01)

(58) Field of Classification Search
None
See application file for complete search history.

(56) References Cited

U.S. PATENT DOCUMENTS 9,044,956 B2 6/2015 Silverbrook et al.
2005/0156981 A1 7/2005 Silverbrook et al.
2013/0093808 A1* 4/2013 Kanno ..... B41J 2/04508 347/9
2015/0343817 A1* 12/2015 Yokozawa ..... B41J 2/0454 347/17

FOREIGN PATENT DOCUMENTS

JP 2010-012795 A 1/2010

OTHER PUBLICATIONS

IP.com search.*

* cited by examiner

*Primary Examiner* — Lisa M Solomon
(74) *Attorney, Agent, or Firm* — Fitzpatrick, Cella, Harper & Scinto

(57) ABSTRACT

Provided are a printing device and a print element substrate having a detection element row provided in correspondence to an ejection port row and capable of suppressing an increase in a length in an ejection port row direction. For that purpose, a row selection circuit 117 is provided in a detection element circuit 108, and a row of the detection element circuit is selected by row selection signals A0 and A1 transmitted through a common wiring.

16 Claims, 8 Drawing Sheets

101
102
102b
101a
103
104
105
106
107
108
109
110
111
112
113
114
115
116
117
118
119
120
122
123
124
125
126
127
128
129
130
131
132
133
134
135
136
137
720
ID
CLKS
LTS
DS
A0
A1
S+
S-
IS
HE
LT
CLK
D
C1 (CLK, D)
C2 (CLK, D)
C3 (CLK, D)
C4 (CLK, D)
CS (S+, S-, IS)

PRINT ELEMENT SUBSTRATE, LIQUID EJECTION HEAD, AND PRINTING DEVICE

BACKGROUND OF THE INVENTION

Field of the Invention

The present invention relates to a print element substrate, a liquid ejection head, and a printing device configured to eject a liquid from an ejection port and particularly to a print element substrate, a liquid ejection head, and a printing device incorporating a check unit used for checking quality of ejection.

Description of the Related Art

In a printing device which performs printing by ejecting a liquid from an ejection port included in a print ejection head, a higher image quality and a higher speed printing are in demand, and a full-line type print head in which print element substrates are arranged in plural over a print width and which performs printing with a large number of ejection ports has been disclosed recently.

Japanese Patent Laid-Open No. 2010-012795 discloses a configuration in which ejection port rows are overlapped in an ejection port row direction at a connecting portion of the print element substrate by arraying the print element substrates in a staggered manner or giving an angle to end portions of the print element substrates while arraying them in one row. By arranging print element substrates with the angle on the end portions, a distance between the ejection ports of the adjacent print element substrates can be reduced as compared with arraying the print element substrates in the staggered manner. Since the distance between the ejection ports of the adjacent print element substrates is reduced, a shift in the ejection port row at the connecting portion is reduced, and an impact position shift of the liquid can be suppressed.

Moreover, in the print element substrate, a measure is proposed which, by providing a detection element for detecting a temperature at each ejection port and by identifying an ejection port with defective ejection on the basis of a detection result of this detection element, reflects the identification to image complement or recovery work of a print head.

In the print element substrate in which a detection element row in which the detection elements for detecting temperature information or the like are disposed in plural is provided in correspondence to the ejection port row, a following problem occurs. That is, between the ejection port at the end portion of the ejection port row and an end portion of the print element substrate, a drive circuit for driving the print element, the detection element circuit, and connected wiring are routed in large quantity. In the case where the number of wirings increases in a wiring region where the wiring is routed, the wiring region needs to be taken wide. Particularly, in the print element substrate in which the detection elements are provided in correspondence to each ejection port, the print element substrate has more wirings and the wiring region becomes large.

As described above, in the case where the wiring region becomes large, a length of the print element substrate in the ejection port row direction becomes long. Particularly in the case where a plurality of the print element substrates is arrayed in one row by giving an angle to an extended end portion of the print element substrate, in a case where the wiring region between the end portion of the ejection port row and the end portion of the detection element row becomes large, a shift in the ejection port row at the connecting portion increases, and there is a concern that an impact position of the liquid shifts.

SUMMARY OF THE INVENTION

Thus, the present invention provides a print element substrate having a detection element row provided in correspondence to an ejection port row and capable of suppressing an increase in a length in an ejection port row direction, a liquid ejection head, and a printing device.

Thus, the print element substrate of the present invention is a print element substrate comprising: a plurality of ejection element rows in which a plurality of ejection elements used for ejecting a liquid forms a row; a plurality of detection element rows which is provided in correspondence to the ejection element rows and in which a plurality of detection elements for detecting a state of ejection of the liquid forms a row; a control unit that controls selection of the detection element for performing detection from the plurality of detection elements and selection of the detection element row including the detection element for performing detection from the plurality of detection element rows; a row selection unit provided in correspondence to the detection element row and selecting the corresponding detection element row on the basis of the selection of the detection element row by the control unit; and a first common wiring provided in common to the plurality of detection element rows, wherein each of the plurality of detection element rows and the control unit are connected through the row selection unit corresponding to the detection element row and the first common wiring and wherein the first common wiring is wired through a region between an end portion of the print element substrate in a direction of the ejection element row and an end portion of the ejection element row as well as an end portion of the detection element row.

According to the present invention, in the print element substrate having a detection element row provided in correspondence to an ejection port row, an increase in the length of the print element substrate in the ejection port row direction can be suppressed.

Further features of the present invention will become apparent from the following description of exemplary embodiments with reference to the attached drawings.

DESCRIPTION OF THE EMBODIMENTS

First Embodiment

Figures 1A, 1B, 1C, 1D:
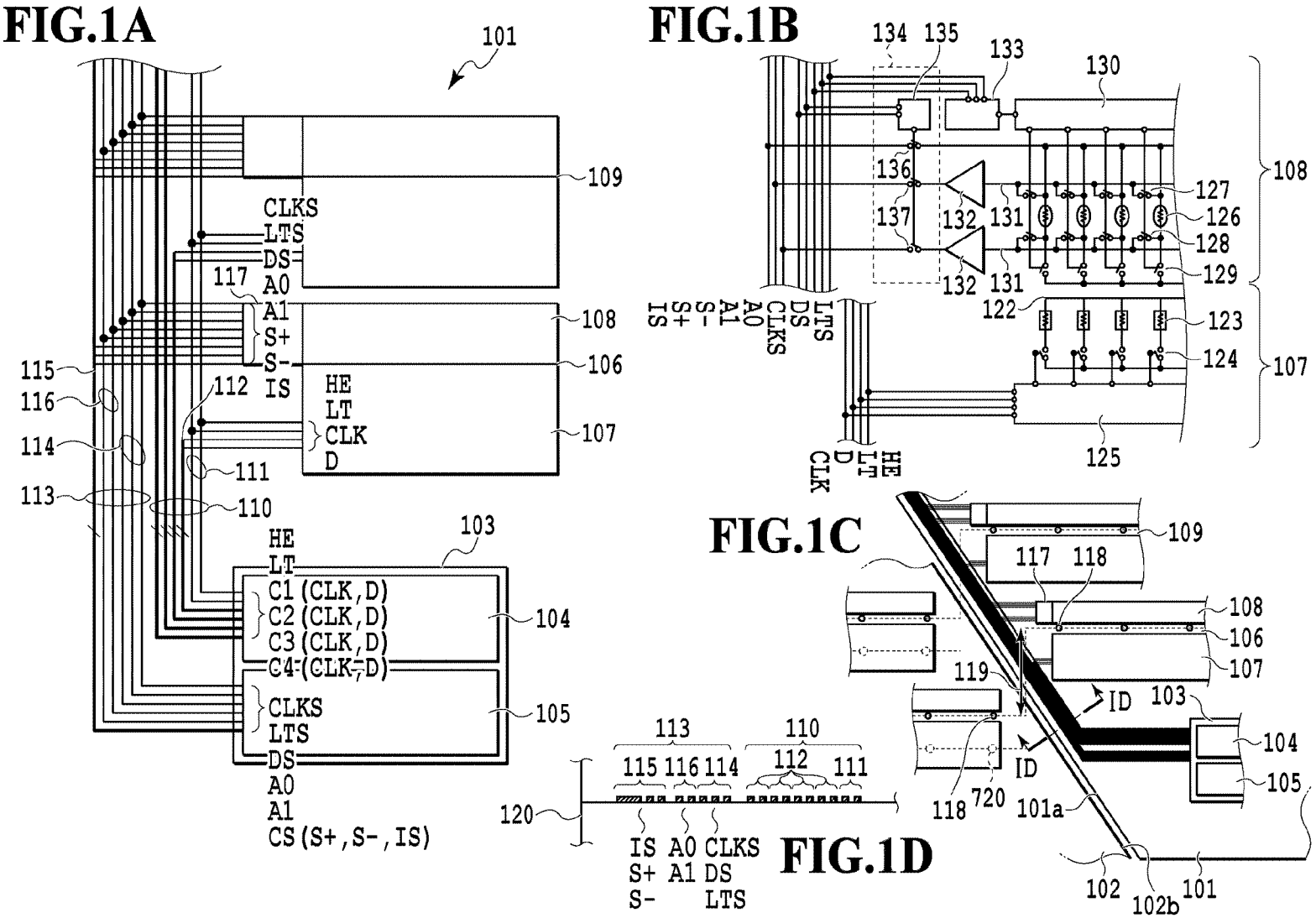
FIG. 1A is a view illustrating wiring of a print element substrate including a function of ejection check.
FIG. 1B is a view illustrating wiring of the print element substrate including the function of ejection check.
FIG. 1C is a view illustrating wiring of the print element substrate including a function of ejection check.
FIG. 1D is a view illustrating wiring of the print element substrate including the function of ejection check.

A first embodiment of the present invention will be described below by referring to the drawings.

In describing the embodiment of the present invention, a form of a comparative example will be described at first. A print element used for a print element substrate which will be described here is a print element which causes a liquid droplet to be ejected from an ejection port by generating a pressure upon receipt of thermal or mechanical energy. Moreover, the print element substrate includes a detection element at each ejection port, and the detection element is a detection element detecting a temperature or a pressure or a physical amount of electrostatic capacitance and here, a form suitable particularly for a temperature detection element will be described. By obtaining a temperature profile by using the temperature detection element, a state of ejection of the liquid whether an ejection state is normal or defective can be detected.

Note that the defective ejection state includes defective ejection caused by remaining air bubbles in a channel or defective ejection caused in a case where impurities were deposited on the channel and refilling of the liquid was not performed normally. Moreover, there are defective ejection which occurred by the liquid depositing on a surface of the ejection port, defective ejection which occurred by clogging of the impurities in the ejection port, and the like.

Figure 6B:
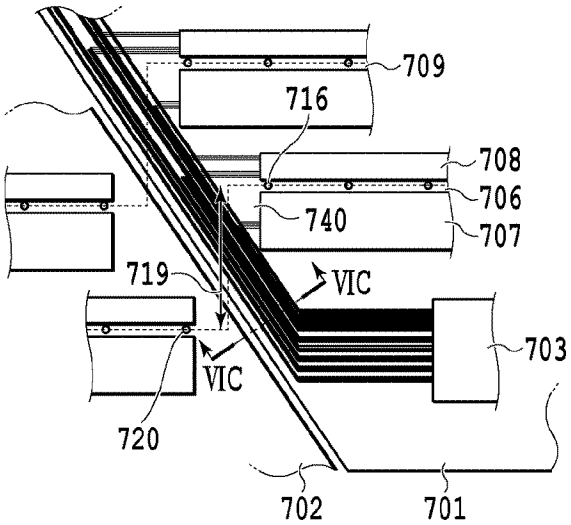
FIG. 6B is a view illustrating wiring of the print element substrate of the comparative example including the function of ejection check.
Figure 6C:
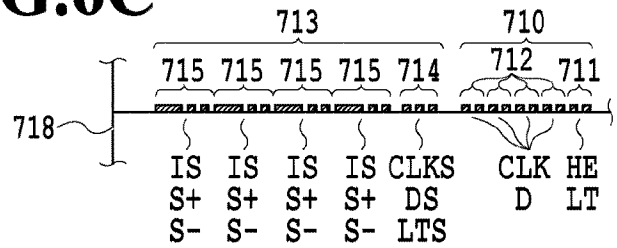
FIG. 6C is a view illustrating wiring of the print element substrate of the comparative example including the function of ejection check.
Figure 6A:
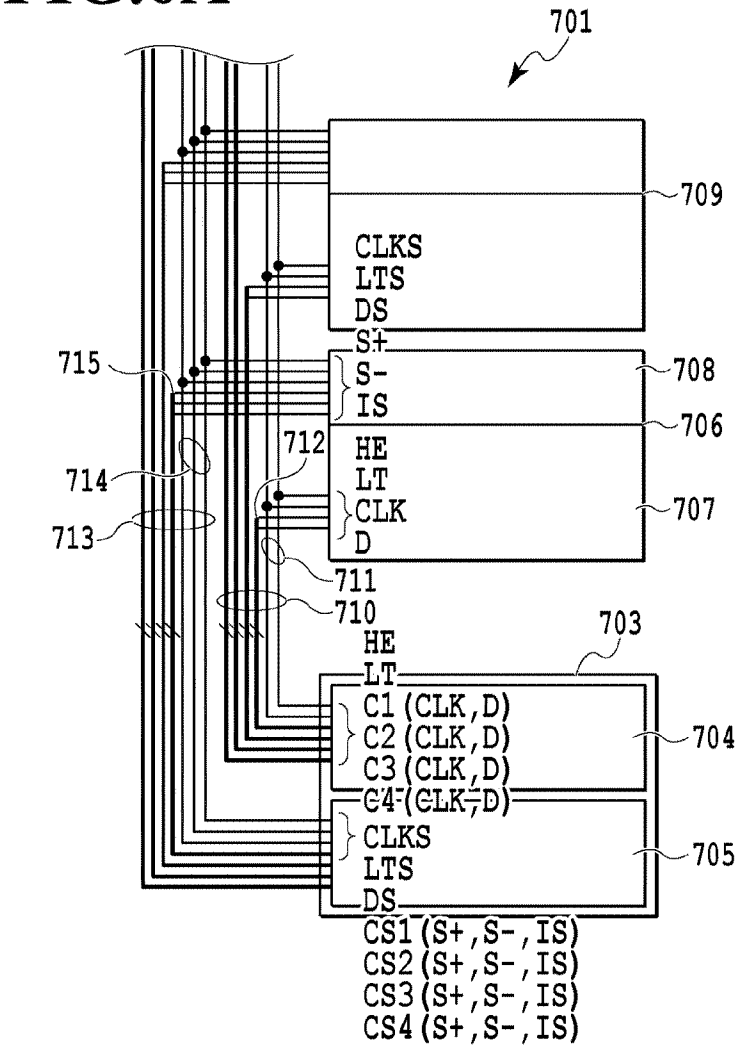
FIG. 6A is a view illustrating wiring of the print element substrate of a comparative example including the function of ejection check.

FIG. 6A is a schematic view illustrating wiring of a print element substrate of a comparative example including a print element and a detection element and having a function of ejection check. FIG. 6B is a view illustrating an appearance layout of the wiring in an actual print element substrate, and FIG. 6C is a sectional view on VIC-VIC in FIG. 6B. A control circuit 703 includes a control circuit 705 and a control circuit 704 and controls a drive circuit driving the print element constituting print element rows corresponding to four ejection port rows in the print element substrate and a detection element circuit. The circuit 706 includes a print element drive circuit 707 and a detection element circuit 708 on a first row and is connected to the control circuit 703 through a plurality of wirings.

The control circuit 704 controlling a print element drive circuit of the control circuit 703 and the print element drive circuit 707 are connected by a bundle 710 of wirings. The bundle 710 of wirings has an individual wiring bundle 712 and a common wiring bundle 711. A clock signal CLK and a data signal D of a serial data transfer signal are transmitted to the print element drive circuit provided in each of the print element rows through the individual wiring bundles 712, respectively. Moreover, a latch signal LT and a drive application signal HE of data are transmitted through the common wiring bundle 711 provided in common to the print element drive circuit provided in each of the print element rows.

Moreover, the control circuit 705 controlling the detection element circuit in the control circuit 703 and the detection element circuit 708 are connected through a wiring bundle 713. A clock signal CLKS, a data signal DS, and a latch signal LTS of a serial data transfer signal transferring data for selecting the detection element are transmitted through a bundle 714 of the common wirings provided in common to the detection element circuit provided in each of the print element rows. Moreover, a power supply IS for feeding power to the detection element and terminal voltages S+ and S− of the detection element of detection information are connected individually to the detection element circuit provided in each of the print element rows, respectively, through the bundle 715 of wiring. The number of wirings of the bundle 713 of the wirings and the bundle 710 of the wirings is 25 in total (see FIG. 6C).

As illustrated in FIG. 6C, these wirings are aligned as the bundle 713 of the wirings for connecting the control circuit 705 and the detection element circuit 708 and the bundle 710 of the wirings for connecting the control circuit 704 and the print element drive circuit 707 in order from a substrate end portion 718 side of the print element substrate 701. Particularly, the wirings of the power supply IS connected to the detection element circuit 708 and the terminal voltages S+ and S− should be wired by giving consideration to avoidance of noise superposition due to analog signals. Thus, the wirings of the power supply IS and the terminal voltages S+ and S− are desirably wired on a substrate end side with fewer noise sources so as not to cross the print element drive circuit 707 which is a noise source. Thus, the wiring connecting the detection element circuit 708 and the control circuit 705 in each row is arranged on the substrate end portion 718 side.

Subsequently, a configuration of the print element substrate in this embodiment will be described.

FIG. 1A is a schematic view illustrating wiring of the print element substrate including the print element (ejection element) and the detection element and having a function of ejection check in this embodiment. A plurality of the print elements makes a row and forms a print element row (ejection element row). Moreover, a plurality of the detection elements also makes a row and forms a detection element row. Here, a configuration relating to the drive circuit for driving the print element is the same configuration as those described in the form of the comparative example. A circuit 106 includes a print element drive circuit 107 and a detection element circuit 108 on a first row and is connected to a control circuit 103 through the plurality of wirings. A control circuit 105 of the detection element circuit and the detection element circuit 108 in the control circuit 103 are connected through a bundle 113 of wiring. Each signal of the clock CLKS, the data DS, and the latch LTS of a serial data transfer signal for transferring the data (detection element selection signal) for selecting the detection element is transmitted through a bundle 114 of common wiring in the bundle 113 of wiring. Then, row selection signals A0 and A1 for selecting a row of the detection element circuit are transmitted through a bundle (row selection signal transmission wiring) 116 of common wiring. Moreover, in the bundle 113 of wiring, the power supply IS feeding electricity to the detection element and the terminal voltages S+ and S− of the detection element of the detection information are transmitted to a row selection circuit 117 as a row selection unit of each row through a bundle 115 of common wiring (detection information transmission wiring).

In this embodiment, it is so configured that the row selection circuit 117 is provided in the detection element circuit 108 provided in each of the print element rows and the row of the detection element circuit is selected by the row selection signals A0 and A1 and thus, the number of wirings can be reduced. As a result, the number of wirings of the bundle 114 of common wiring, the bundle 116 of common wiring, and the bundle 115 of common wiring are 18 wires in total (see FIG. 1D which will be described later).

Specific circuit configuration together with a selecting method, of a row of the detection element circuit in this embodiment will be described below.

FIG. 1B is a view illustrating detailed circuit configuration of the print element drive circuit 107 using a heating resistance element as the print element and the detection element circuit 108 using a temperature-sensitive resistance element as the detection element. In the drive circuit 107 for driving the print element, one terminal of a print element 123 is connected to a power supply line 122, while the other terminal is connected to a drive switch 124. The drive switch 124 is on/off controlled in a selection circuit 125 which expands and stores print data transferred in serial data. The detection element circuit 108 includes a shift register 133 for expanding and storing selection data of the detection element transferred in serial data and a decoder 130 for selecting an arbitrary detection element which performs detection upon receipt of the selection data. Moreover, the detection element circuit 108 includes an analog switch multiplexer 134 for switching selection of the detection element row including detection elements 126 performing detection upon receipt of the row selection signals A1 and A0. Moreover, the detection element circuit 108 includes an array of the detection elements 126 and a pair of buffer amplifiers 132 for buffering the signal detected by the detection element 126. Note that this embodiment is configured such that the detection element 126 is provided in correspondence to each of the print elements 123 but the detection element 126 does not have to be provided for each of the print elements 123. It is only necessary that a row of the detection elements 126 constituted by disposing a plurality of the detection elements 126 is provided in correspondence to one row of the print elements 123.

One terminals of the detection element 126 are commonly connected to the wiring of the power supply IS (constant current, here) feeding electricity to the detection elements 126, while each of the other terminals is connected to a selection switch 129. Moreover, the both terminals of the detection element 126 are connected to read-out switches 127 and 128 for reading out terminal voltages, respectively. The other terminals of the read-out switches 127 and 128 are connected to a pair of common wirings 131, respectively, and the common wirings 131 are connected to the buffer amplifier 132. The selection switch 129 and the read-out switches 127 and 128 are on/off controlled by the decoder 130.

The analog switch multiplexer 134 includes a decoder 135 fixed to decode specific to each row, a switch 136 for selecting the power supply IS, and a pair of switches 137 for selecting an output signal of the buffer amplifier 132. In a case where the row selection signals A1 and A0 and the selection data of the detection element are sent from the control circuit 105, the detection element of the specified row and the analog switch multiplexer 134 are selected. Then, the power supply IS of the common wiring feeds electricity, and the terminal voltage of the detection element 126 is output to the wiring S+ and the wiring S− of the common wiring.

Figure 7A:
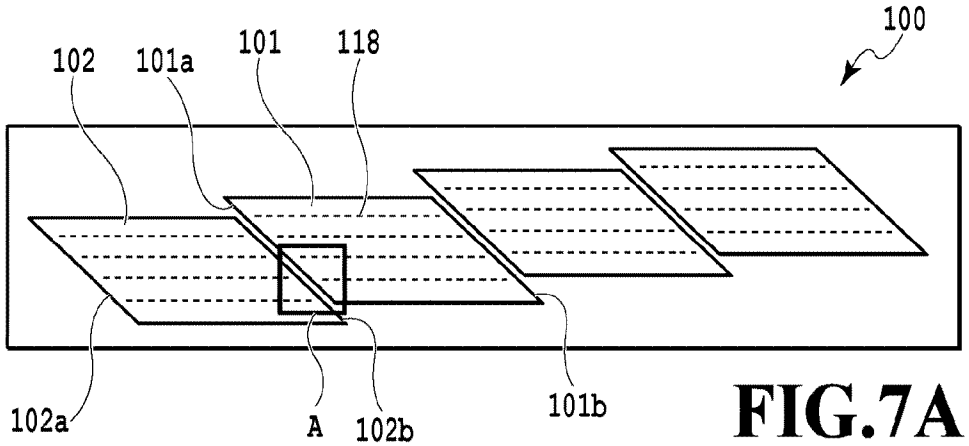
FIG. 7A is a view for explaining arrangement of the print element substrate in a print head.

FIG. 1C is a view illustrating an appearance layout of wiring in a connecting portion of adjacently arranged print element substrates and is a view illustrating a region A of a print head 100 illustrated in FIG. 7A in an enlarged manner. FIG. 1D is a sectional view on Id-Id in FIG. 1C. A print element substrate 101 and a print element substrate 102 include outer edges (end portions) crossing, at a sharp angle, a direction where the ejection element row extends. The print element substrate 101 and the print element substrate 102 are provided so that the end portions thereof are adjacent to each other. Here, the print element substrate 101 and the print element substrate 102, that is, two print element substrates disposed adjacent to each other are illustrated as a part of a print head as a liquid ejection head. A plurality of the print element substrates is disposed so that the end portions of the print element substrates extending in the direction crossing in the direction of the ejection element row are adjacent to each other so as to configure a full-line type print head. In the wiring in the print element substrate of this embodiment, the wiring bundle 113 connecting the control circuit 105 and each of the detection element circuits 108 and the wiring bundle 110 for serial data transfer connecting the control circuit 104 and each of the print element drive circuits 107 are aligned in order from a substrate end portion 101*a* as in FIG. 1D. Moreover, the bundle 113 for common wiring is aligned in order of the bundle 115 of common wiring of the power supply IS and the detection signals S+ and S−, the bundle 116 of common wiring of the row selection signals A0 and A1, and the bundle 114 of common wiring of CLKS, DS, and LTS of the serial data transfer signal.

As described above, in this embodiment, the row selection circuit 117 is provided in the detection element circuit 108, and the row selection circuit 117 which received the row selection signals A0 and A1 transmitted through the common wiring common to the plurality of detection element rows switches selection of the corresponding detection element row. As a result, by making the wiring connecting the control circuit 103 to the print element drive circuit and the detection element circuit common wiring and by enabling selective signal transmission, the number of wirings can be reduced to 18 and a wiring region in the substrate end portion can be made narrow. As a result, a connection distance 119 of an ejection port 118 in the connecting portion between the print element substrate 102 and the print element substrate 101 can be made shorter than a connection distance 719 in the comparative example. (see FIG. 6B).

As a result, the print element substrate having the detection element row provided in correspondence to the ejection port row and capable of suppressing an impact position shift of the liquid in the connecting portion and the printing device were able to be realized. Moreover, by means of the print element substrate having the detection element row provided in correspondence to the ejection port row, an increase in the length of the print element substrate in the ejection port row direction was able to be suppressed.

Figure 7C:
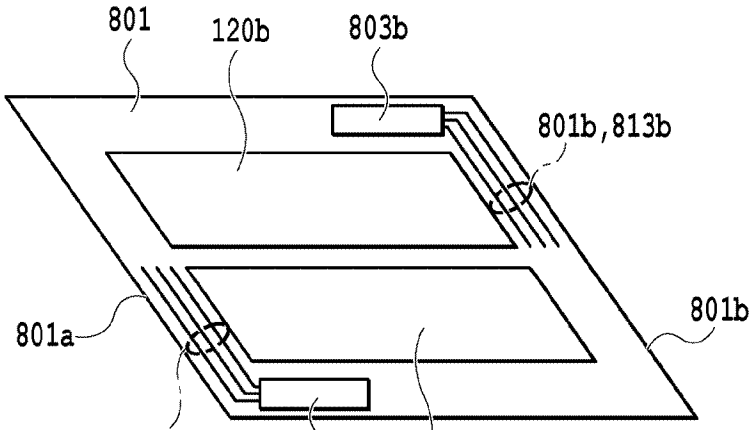
FIG. 7C is a view for explaining the position of wiring in the print element substrate.
Figure 7B:
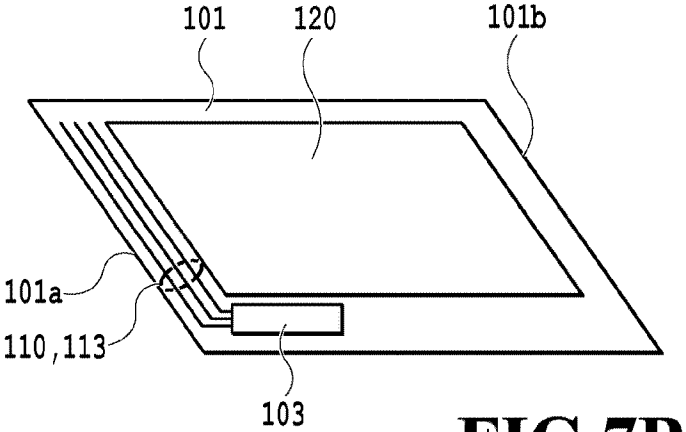
FIG. 7B is a view for explaining a position of wiring in the print element substrate.

FIG. 7B is a view illustrating a layout of the bundle 110 of wiring for print element and the bundle 113 of wiring for detection element in the print element substrate 101. These bundles 110 and 113 of wiring connect a circuit portion 120 including a plurality of circuits 106 each having the print element and the detection element and the control circuit 103. As described above, the row selection circuit 117 is arranged on one end portion of the detection element row, and the bundle 113 of wiring is arranged between this end portion and the end portion 101*a* of the print element substrate close to this end portion. Moreover, the row selection circuit 117 is not arranged on the other end portion of the detection element row of the print element substrate 101, and a bundle of wiring is not arranged, either, between the other end portion and an end portion 101*b* of the print element substrate 101 close to the other end portion. Then, as illustrated in FIG. 1C and FIG. 7A, in the print head 100, the one end portion 101*a* on which the bundle 113 of wiring of the print element substrate 101 and the other end portion 102*b* on which a bundle of wiring of the print element substrate 102 is not provided are arranged adjacent to each other.

FIG. 7C is a view illustrating a layout of a bundle 810 of wiring for print element and a bundle 813 of wiring for detection element in a print element substrate 801 of a modification. In a case where there are many ejection port rows arranged in one print element substrate 801, it may be so constituted that a circuit is divided into two, that is, a circuit 120*a* and a circuit 120*b*, and control circuits 803*a* and 803*b* are provided so as to correspond to the circuit 120*a* and the circuit 120*b*, respectively. In this case, bundles 810*a* and 813*a* of wiring connected to the circuit 120*a* are arranged on one end portion 810*a* of the print element substrate, while bundles 810*b* and 813*b* of wiring connected to the circuit 120*b* are arranged in the other end portion 810*b*. In a case where the print head is to be constituted by using a plurality of the print element substrates 801 in the modification, too, it is only necessary that the one end portion 801*a* of the print element substrate 801 and the other end portion 801*b* of another print element substrate 801 are arranged adjacent to each other.

Note that, while the bundle 115 of common wiring of an analog signal is arranged on the end portion side of the print element substrate by giving consideration to suppression of noise superposition, particularly, the bundle 116 of common wiring of row selection is arranged between the wirings 114 and 110 which are also noise sources and the bundle 115 of common wiring, here. Since the row selection signals A0 and A1 inevitably enter a constant voltage state during a period during which the detection element is selected and the detection information is read out, a shield effect against the noise source can be expected.

Figure 2A:
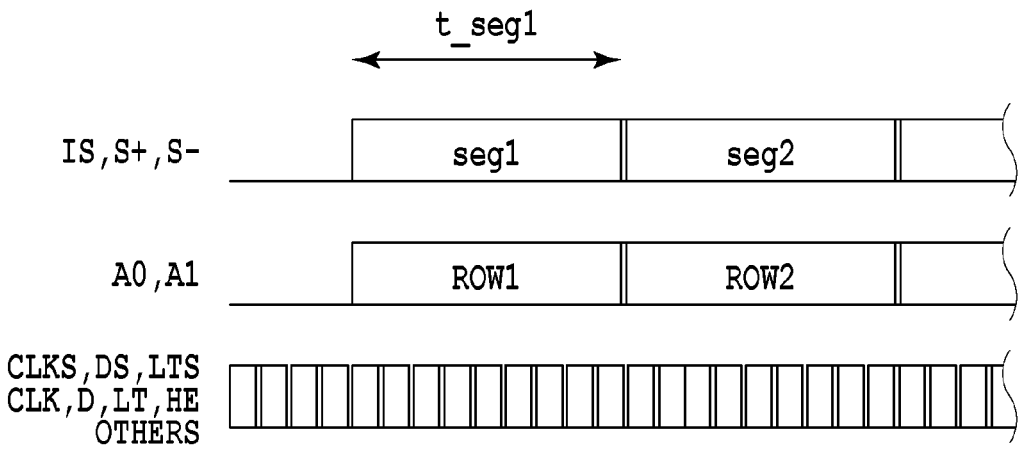
FIG. 2A is a view illustrating signal timing.

FIG. 2A is a chart illustrating a timing relationship among the row selection signals A0 and A1, the wirings 114 and 110 of a digital operation, and the analog signals IS, S+, and S−. With respect to the signal of the digital operation operating at all times, during a period t_seg1 in which a detection element seg1 is selected, the row selection signals A0 and A1 show constant voltages, whereby a shield effect can be obtained.

Modification

Figure 2B:
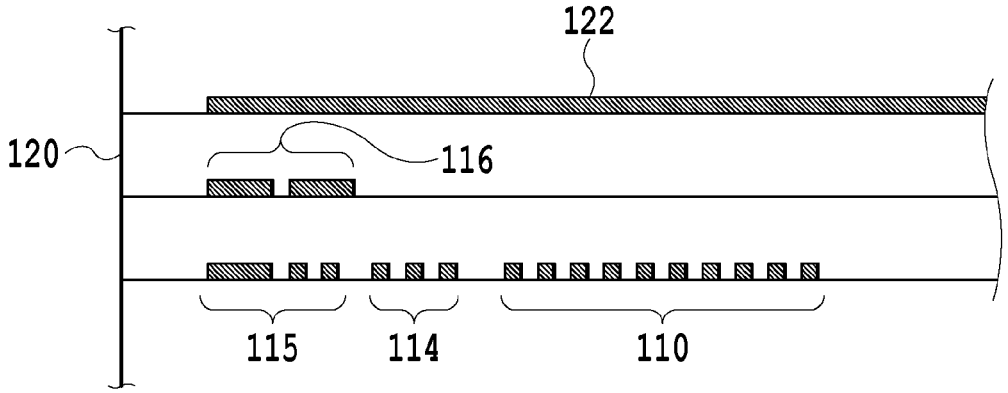
FIG. 2B is a view illustrating a modification.

FIG. 2B is a sectional view illustrating a modification of the print element substrate of this embodiment. In the aforementioned form in the first embodiment, a form of alignment of wirings arranged in the same wiring layer is described, but in the modification, a form which can obtain the similar shield effect also between wiring layers will be described. In the print element substrate in the modification, in a case where the bundle 115 of common wiring of an analog signal is arranged in a first layer and the power supply line 122 of the print element 123 which becomes a noise source is arranged in a third layer, the shield effect can be expected by arranging a common wiring 116 for row selection in a second layer.

Second Embodiment

A second embodiment of the present invention will be described below by referring to the drawings. Note that, since basic configuration of this embodiment is similar to the first embodiment, only characteristic configuration will be described below. In this embodiment, a form in which the number of wirings for connecting the control circuit and each of the detection element circuits in four rows is further reduced will be described.

Figure 3B:
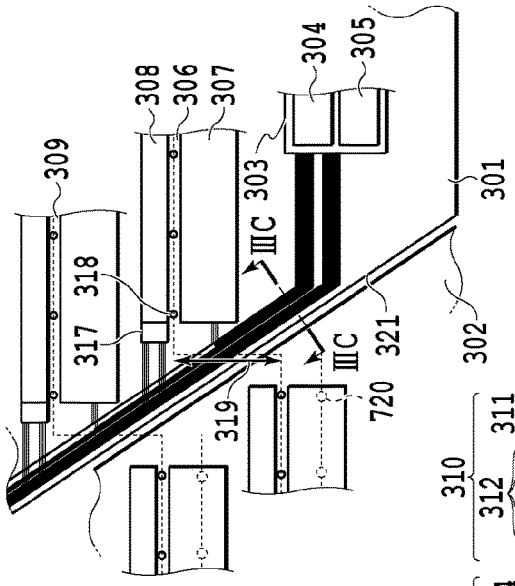
FIG. 3B is a view illustrating wiring of the print element substrate including the function of ejection check.
Figure 3C:
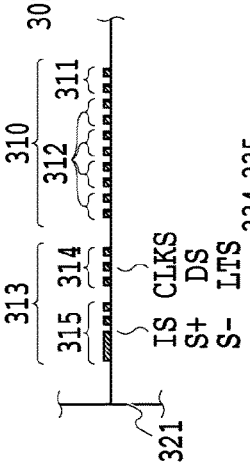
FIG. 3C is a view illustrating wiring of the print element substrate including the function of ejection check.
Figure 3D:
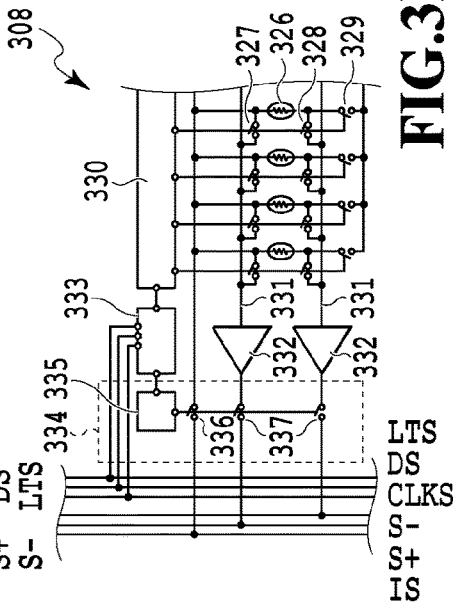
FIG. 3D is a view illustrating wiring of the print element substrate including the function of ejection check.
Figure 3A:
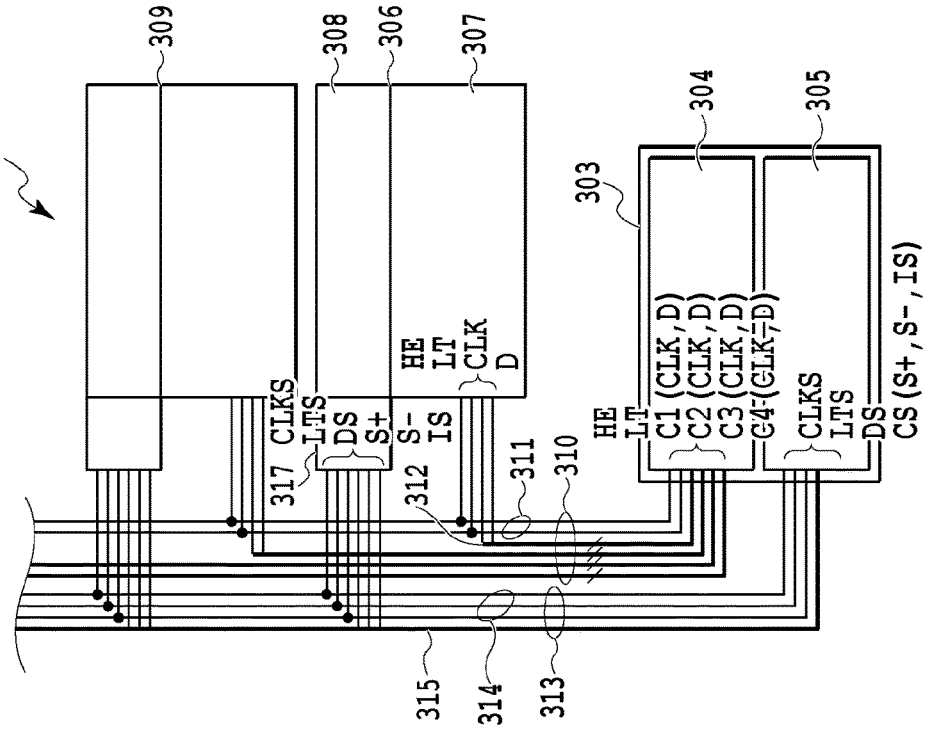
FIG. 3A is a view illustrating wiring of the print element substrate including the function of ejection check.

FIG. 3A is a view illustrating a wiring at a connecting portion of a print element substrate 301 including the detection element together with the print element and having a function of ejection check. Moreover, FIG. 3B is a view illustrating an appearance layout of the wiring at the connecting portion in an actual print element substrate, and FIG. 3C is a sectional view on IIIC-IIIC in FIG. 3B. In this embodiment, since a configuration relating to the print element drive circuit is similar to the first embodiment, description will be omitted.

A circuit 306 in this embodiment includes a print element drive circuit 307 and a detection element circuit 308 on the first row, and a control circuit 305 of the detection element circuit and each of the detection element circuits 308 in four rows in a control circuit 303 are connected through a bundle 313 of wiring. In this embodiment, as compared with the first embodiment, common wirings of the row selection signals A0 and A1 for selecting a row are reduced. In this embodiment, in addition to data for selecting the detection element, row selection data for selecting a row is also transmitted in a serial data transfer signal so that reduction of the common wirings of the row selection signals A0 and A1 is realized.

The clock signal CLKS, the data signal DS, and the latch signal LTS of the serial data transfer signal for transferring data for selecting the detection element are transmitted to each row through a bundle 314 of common wiring. The power supply IS for feeding electricity to the detection element and the terminal voltages S+ and S− of the detection element of detection information are transmitted to a row selection circuit 317 in each row through a bundle 315 of common wiring. In this embodiment, row selection data for selecting a row is also transmitted through the bundle 314 of common wiring. As a result, the number of wirings of the bundle 314 of common wiring and the bundle 315 of common wiring becomes 16 in total (see FIG. 3C).

FIG. 3D is a view illustrating a circuit configuration of the detection element circuit (including the row selection circuit) 308 using a temperature-sensitive resistance element as the detection element. The circuit configuration of this embodiment different from the first embodiment is a circuit of a portion receiving the serial data transfer signal, and configurations of the other circuits (a decoder, a circuit of the detection element, a buffer amplifier, and an analog switch multiplexer) are the same as those of the first embodiment.

In this embodiment, the selection data and the row selection data of the detection element transferred in the serial data are expanded and stored in a shift register 333. Then, a signal of the row selection data is transmitted to a decoder 335 fixed to decode specific to each row included in an analog switch multiplexer 334. The detection element in a specified row for which the row selection data is sent from the control circuit 305 and the analog switch multiplexer 334 are selected, and the power supply IS commonly wired feeds electricity, and the terminal voltage of the detection element is output to the wiring S+ and the wiring S− commonly wired.

The wiring in the connecting portion of the print element substrate is aligned in order from the substrate end portion of the print element substrate 301 such as the bundle 313 of wiring for connecting the control circuit 305 and each of the detection element circuits 308 in four rows and a bundle 310 of wiring for connecting a control circuit 304 and each of the print element drive circuits 307 in four rows. Then, the bundle 313 of common wiring connected to the detection element circuit 308 is aligned in order of the bundle 315 of common wiring of the power supply IS and the detection signals S+ and S− and the bundle 314 of common wiring of the serial data transfer signals CLKS, DS, and LTS.

In this embodiment, by transferring the row selection data for selecting a row as serial data, the number of wirings of the row selection signal was reduced, and a wiring region on the substrate end portion in the connecting portion was further reduced. As a result, a connection distance 319 of the ejection port in the connecting portion between a print element substrate 302 and the print element substrate 301 was made shorter than the connection distance 719 (see FIG. 6B) of the comparative example.

Note that, in a case where the shield effect described in the first embodiment is to be added, it is only necessary to arrange GND wiring between the noise source and the bundle 315 of common wiring of an analog signal.

Third Embodiment

A third embodiment of the present invention will be described below by referring to the attached drawings. Note that, since a basic configuration of this embodiment is similar to the first embodiment, only characteristic configuration will be described below. In this embodiment, a form in which the number of wirings for connecting the control circuit and each of the print element drive circuits in four rows is reduced will be described.

Figure 4B:
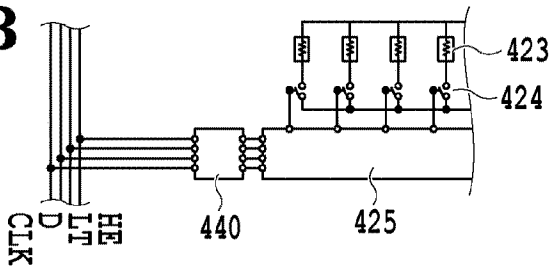
FIG. 4B is a view illustrating wiring of the print element substrate including the function of ejection check.
Figure 4C:
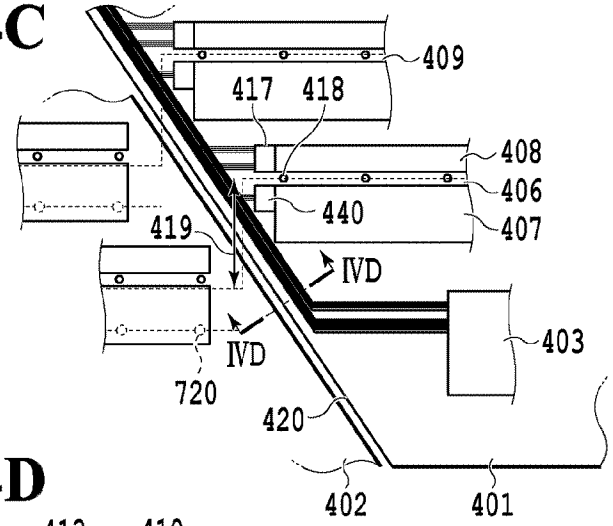
FIG. 4C is a view illustrating wiring of the print element substrate including the function of ejection check.
Figure 4D:
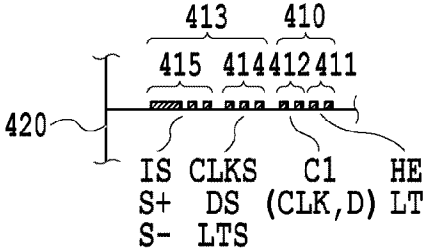
FIG. 4D is a view illustrating wiring of the print element substrate including the function of ejection check.
Figure 4A:
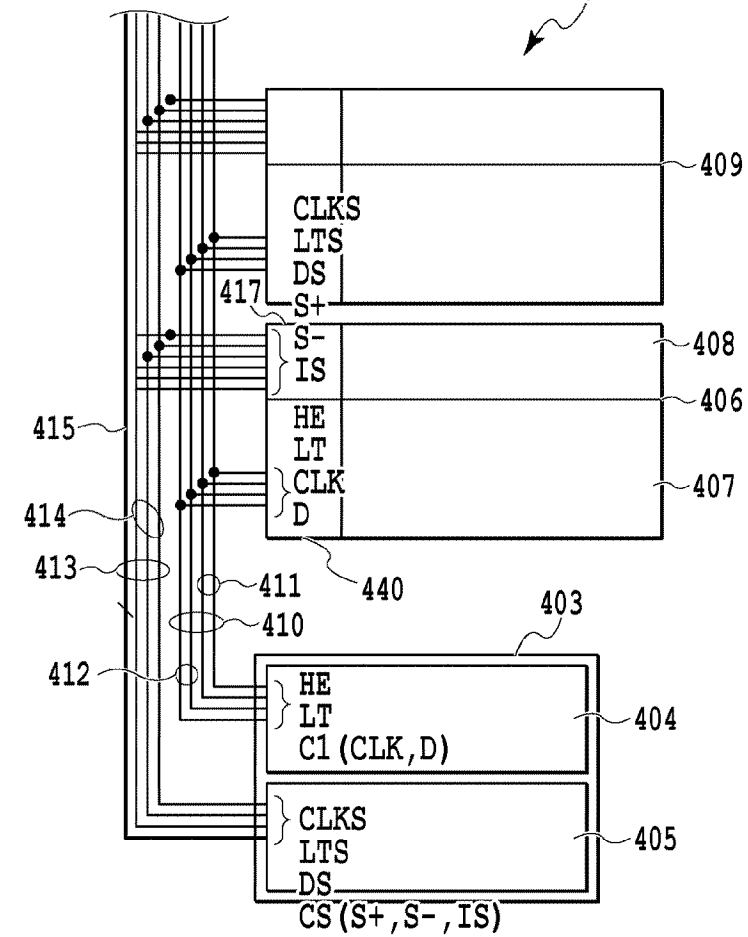
FIG. 4A is a view illustrating wiring of the print element substrate including the function of ejection check.

FIG. 4A is a view illustrating wiring in a connecting portion of a print element substrate 401 including a detection element together with a print element and having a function of ejection check. Note that a configuration relating to the detection element circuit is the same as those described in the second embodiment.

A circuit 406 is a circuit constituted by a print element drive circuit 407 and a detection element circuit 408 on a first row. A control circuit 404 of the print element drive in a control circuit 403 and each of the print element drive circuits 407 in four rows are connected through a bundle 410 of wiring.

The configuration of this embodiment is different from the first and second embodiments in that the CLK signal and the D signal for serial data transfer transmitted to each of the print element drive circuits 407 in four rows through the bundle 410 of wiring are made common wiring so as to reduce the number of wirings of the CLK signal and the D signal wired individually for each row.

The clock signal CLK and the data signal D of the serial data transfer signal transmitted to each of the print element drive circuits 407 in four rows and selecting the print element row (which is the ejection element row selection signal) are transmitted through the bundle 410 of common wiring to each row, and the number of wirings relating to print element drive is four in total. By means of the bundle 410 of common wiring, the latch signal LT of data and the drive application signal HE are transmitted through a bundle 411 of common wiring, and the clock signal CLK and the data signal D of the serial data transfer signal are transmitted by a bundle 412 of common wiring. In the first and second embodiments, the clock signal CLK and the data signal D are transmitted to each of the print element drive circuits in four rows by individual wiring, but in this embodiment, wirings are made common and signals are transmitted through the bundle 412 of common wiring. As a result, the number of wirings is ten in total by adding 6 wirings of a bundle 413 of common wiring connected to the detection element circuit 408.

FIG. 4B is a view illustrating a detailed circuit configuration of the print element drive circuit 407 using a heating resistance element as the print element. The circuit configuration of the print element drive circuit 407 in this embodiment is different from those of the first and second embodiments in that a row selection circuit 440 for receiving a serial data transfer signal is included.

The row selection circuit 440 expands and stores selection data of the print element and row selection data transferred in serial data in a shift register. Then, the row selection circuit 440 incorporates a multiplexer fixed by decode specific to each row upon receipt of the row selection data and turns on/off an input to the print element drive circuit 407.

FIG. 4C is a view illustrating an appearance layout of wiring in a connecting portion of an actual print element substrate, and FIG. 4D is a sectional view on IVD-IVD in FIG. 4C. The bundle 413 of wiring for connecting the control circuit 405 and each of the detection element circuits 408 in four rows and the bundle 410 of common wiring for connecting the control circuit 404 and each of the print element drive circuits 407 in four rows are aligned in order from the substrate end portion 420 of the print element substrate 401. In the bundle 410 of common wiring, the bundle 412 of common wiring for transmitting the serial data transfer signals CLK and D and the bundle 411 of common wiring for transmitting the LT signal and the HE signal are aligned.

In this embodiment, by making the CLK signal and the D signal for serial data transfer transmitted to each of the print element drive circuits 407 in four rows common wiring, the number of serial data transfer wiring wired individually to each row was reduced, and a wiring region on the substrate end portion in the connecting portion was further reduced. As a result, a connection distance 419 of the ejection port in the connecting portion between a print element substrate 402 and the print element substrate 401 was further made shorter than the connection distance 719 (see FIG. 6B) of the comparative example.

Fourth Embodiment

A fourth embodiment of the present invention will be described below by referring to the drawings. Note that, since a basic configuration of this embodiment is similar to that of the first embodiment, only characteristic configuration will be described below.

Figure 5:
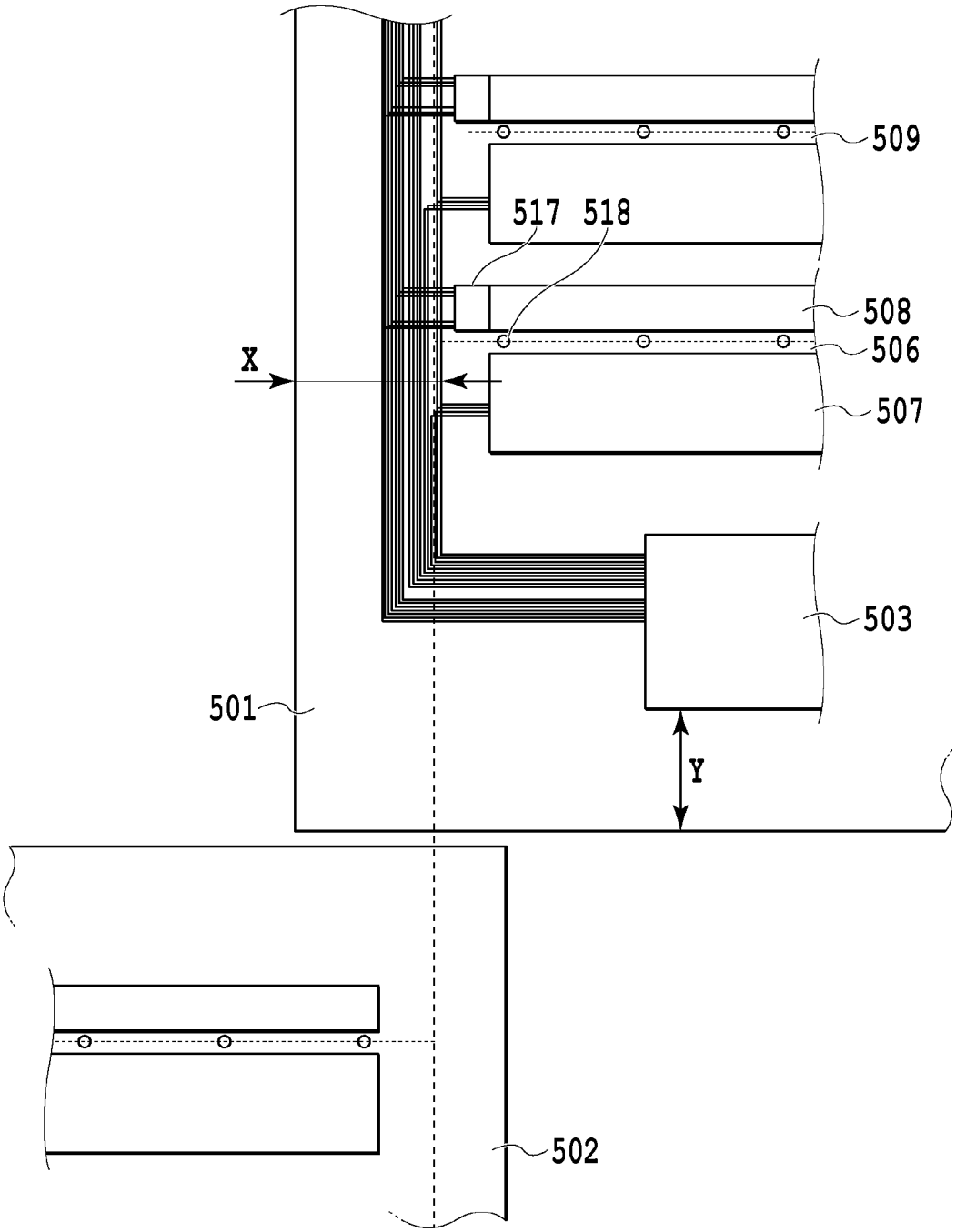
FIG. 5 is a view illustrating wiring of the print element substrate including the function of ejection check.

FIG. 5 is a view illustrating an appearance layout of a wiring group in a substrate end portion region of a connecting portion between print element substrates 501 and 502 in a case where print element substrates each having a normal square shape are arranged in a staggered manner. The circuit configuration, the wiring group connecting the control circuit and each row, and alignment of each wiring are the same as in the first embodiment, the second embodiment or the third embodiment.

In a case of staggered arrangement, a connection distance of the ejection port is determined by a substrate dimension Y of the print element substrate 501 and thus the number of wirings on the substrate end portion does not have an influence, but since a width of the substrate end portion is reduced, a substrate dimension X can be made short. As a result, the dimension of the print head in the ejection port row direction can be made small.

Print Head and Printing Device

An example of an inkjet print head (liquid ejection head) on which the print element substrate of the aforementioned embodiment is mounted and a printing device using this inkjet print head will be described.

Figure 8:
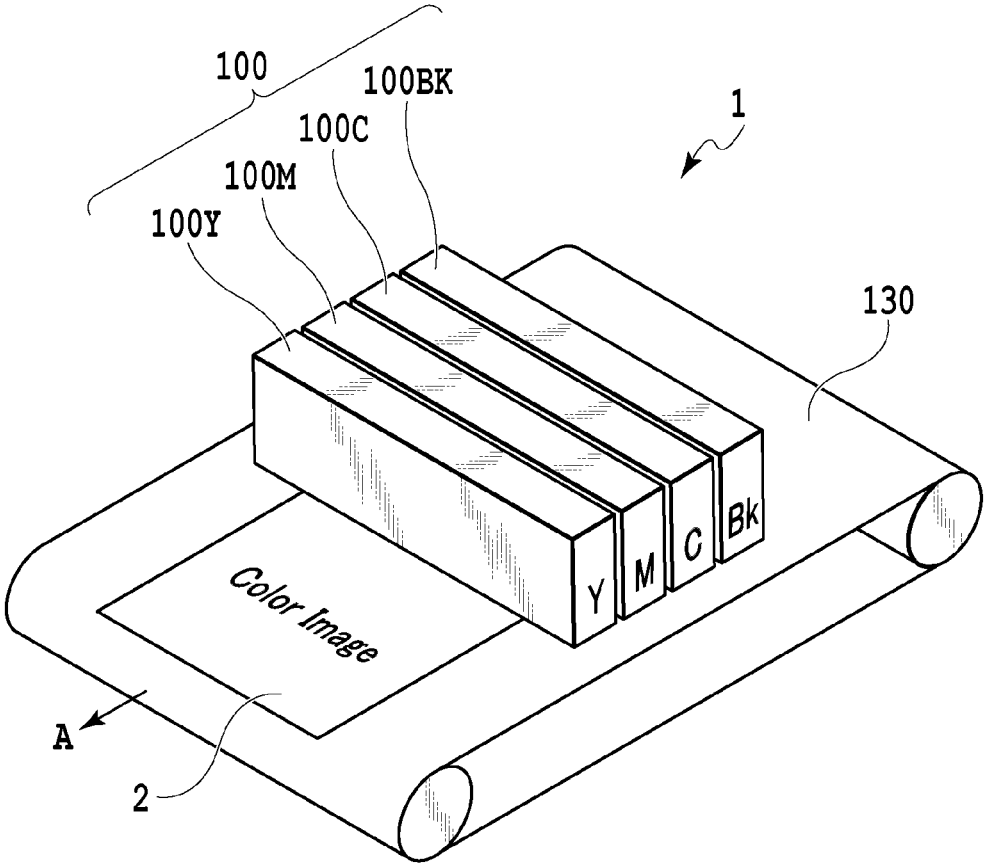
FIG. 8 is a view illustrating a configuration example of a printing device.

FIG. 8 is a schematic perspective view for explaining a configuration example of the inkjet printing device 1 using the inkjet print head 100. The printing device 1 of this example is of a so-called full-line type, and a lengthy print head 100 extending over the entire region in a width direction of a print medium P is used. The print medium P is conveyed continuously in an arrow A direction by a conveying mechanism 130 using a conveyance belt or the like. Ejection of an ink (liquid) from the print head 100 while the print medium P is being conveyed in the arrow A direction causes an image to be printed on the print medium P. In the case of this example, by using print heads 100C, 100M, 100Y, and 100Bk ejecting the ink in cyan (C), magenta (M), yellow (Y), and black (K) as the print head 100, a color image can be printed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2016-106466 filed May 27, 2016, and No. 2017-087600 filed Apr. 26, 2017, which are hereby incorporated by reference wherein in their entirety.

What is claimed is:

1. A print element substrate comprising:

a plurality of ejection element rows in which a plurality of ejection elements used for ejecting a liquid forms a row;

a plurality of detection element rows which is provided in correspondence to the ejection element rows and in which a plurality of detection elements for detecting a state of ejection of the liquid forms a row;

a control unit that controls selection of the detection element for performing detection from the plurality of detection elements and selection of the detection element row including the detection element for performing detection from the plurality of detection element rows;

a row selection unit provided in correspondence to the detection element row and selecting the corresponding detection element row on the basis of the selection of the detection element row by the control unit; and a first common wiring provided in common to the plurality of detection element rows, wherein each of the plurality of detection element rows and the control unit are connected through the row selection unit corresponding to the detection element row and the first common wiring and wherein the first common wiring is wired through a region between an end portion of the print element substrate in a direction of the ejection element row and an end portion of the ejection element row as well as an end portion of the detection element row.

2. The print element substrate according to claim 1, wherein the first common wiring includes a row selection signal transmission wiring for transmitting a signal for selecting the detection element row.

3. The print element substrate according to claim 2, wherein:

the print element substrate is a print element substrate including a plurality of wiring layers;

the first common wiring includes a detection information transmission wiring that transmits detection information detected by the detection element and is different from the row selection signal transmission wiring;

the detection information transmission wiring is wired in a first wiring layer; and the row selection signal transmission wiring is wired in a second wiring layer.

4. The print element substrate according to claim 2, wherein the row selection signal transmission wiring transmits a detection element selection signal for selecting the detection element from the plurality of detection elements.

5. The print element substrate according to claim 1, further comprising, a row selection circuit for selecting the ejection element row from the plurality of ejection element rows, wherein the ejection element row and the control unit are connected by a second common wiring through the row selection circuit.

6. The print element substrate according to claim 5, wherein the second common wiring transmits an ejection element row selection signal for selecting the ejection element row.

7. The print element substrate according to claim 1, wherein the end portion of the print element substrate extends in a direction crossing the direction of the ejection element row.

8. A liquid ejection head comprising a plurality of print element substrates, the print element substrate including a plurality of ejection element rows in which a plurality of ejection elements used for ejecting a liquid forms a row, a plurality of detection element rows which is provided in correspondence to the ejection element rows and in which a plurality of detection elements for detecting a state of ejection of the liquid forms a row, a control unit that controls selection of the detection element for performing detection from the plurality of detection elements and selection of the detection element row including the detection element for performing detection from the plurality of detection element rows, a row selection unit provided in correspondence to the detection element row and selecting the corresponding detection element row on the basis of the selection of the detection element row by the control unit, and a first common wiring provided in common to the plurality of detection element rows, wherein each of the plurality of detection element rows and the control unit are connected through the row selection unit corresponding to the detection element row and the first common wiring, wherein the first common wiring is wired through a region between an end portion of the print element substrate in a direction of the ejection element row and an end portion of the ejection element row as well as an end portion of the detection element row, and wherein the plurality of the print element substrate is provided along the direction of the ejection element row.

9. The liquid ejection head according to claim 8, wherein the plurality of the print element substrate is disposed so that the end portions of the print element substrates are adjacent to each other.

10. The liquid ejection head according to claim 8, wherein the plurality of the print element substrates is disposed so that the end portion of the print element substrate and another end portion of the print element substrate different from the print element substrate, on a side opposite to the end portion in a direction of the ejection element row are adjacent to each other.

11. A printing device comprising a print element substrate having a plurality of ejection element rows in which a plurality of ejection elements used for ejecting a liquid forms a row, a plurality of detection element rows which is provided in correspondence to the ejection element rows and in which a plurality of detection elements for detecting a state of ejection of the liquid forms a row, a control unit that controls selection of the detection element for performing detection from the plurality of detection elements and selection of the detection element row including the detection element for performing detection from the plurality of detection element rows, a row selection unit provided in correspondence to the detection element row and selecting the corresponding detection element row on the basis of the selection of the detection element row by the control unit, and a first common wiring provided in common to the plurality of detection element rows, wherein each of the plurality of detection element rows and the control unit are connected through the row selection unit corresponding to the detection element row and the first common wiring; and wherein the first common wiring is wired through a region between an end portion of the print element substrate in a direction of the ejection element row and an end portion of the ejection element row as well as an end portion of the detection element row.

12. The print element substrate according to claim 7, wherein the direction of extension of the end portion of the print element substrate and the direction of the ejection element row intersect so that one of interior angles formed by the directions is a sharp angle.

13. The liquid ejection head according to claim 8, wherein the end portions of the ejection port rows of the adjacent print element substrates overlap in the direction of the ejection port rows.

14. The liquid ejection head according to claim 8, wherein the liquid ejection head is a full-line type print head.

15. The ejection head according to claim 14, wherein the plurality of the print element substrates are arranged in a row along the direction of the ejection element rows.

16. The liquid ejection head according to claim 10, wherein the other end portion of the print element substrate different from the print element substrate is not provided with the first common wiring.

* * * * *